US005899832A

United States Patent [19]

Hougen

[11] Patent Number: 5,899,832

[45] Date of Patent: May 4, 1999

[54] COMPACT LUNG EXERCISING DEVICE

[76] Inventor: Everett D. Hougen, 5463 Sugarbush, Flint, Mich. 48503

[21] Appl. No.: 08/874,843

[22] Filed: Jun. 13, 1997

Related U.S. Application Data

[ 60] Provisional application No. 60/019,796, Jun. 14, 1996.

[51] Int. Cl.[6] ..... A63B 23/18

[52] U.S. Cl. ..... 482/13; 482/111; 128/200.24; 128/202.13

[58] Field of Search ..... 482/13, 111; 600/538, 600/540; 446/200, 207, 208, 195, 196, 202, 204, 205, 206; 73/239, 241; 128/200.24, 202.13, 207.12; 84/93, 465, 466, 330, 398, 399

[56] References Cited

U.S. PATENT DOCUMENTS

| | | | |
|---|---|---|---|
| 3,079 | 5/1843 | Rose . | |
| D. 321,227 | 10/1991 | Norell . | |
| 515,637 | 2/1894 | Wilhide . | |
| 569,777 | 10/1896 | Williams | 84/93 |
| 635,232 | 10/1899 | Carroll . | |
| 737,008 | 8/1903 | Nichol . | |
| 856,432 | 6/1907 | Thomson . | |
| 940,735 | 11/1909 | Schaeffer et al. . | |
| 1,295,118 | 2/1919 | Canaday . | |
| 1,392,700 | 10/1921 | Oyen . | |
| 2,292,474 | 8/1942 | Paxton . | |
| 3,298,362 | 1/1967 | Lippitt, Jr. et al. . | |
| 3,327,579 | 6/1967 | Brimhall | 84/330 |
| 3,333,844 | 8/1967 | Jurschak . | |
| 3,367,324 | 2/1968 | Bono | 600/540 |
| 3,810,461 | 5/1974 | McCormick . | |
| 3,826,247 | 7/1974 | Ruskin et al. . | |
| 3,863,914 | 2/1975 | O'Connor . | |
| 3,908,987 | 9/1975 | Boehringer . | |
| 3,949,984 | 4/1976 | Navara . | |
| 4,025,070 | 5/1977 | McGill et al. . | |
| 4,054,134 | 10/1977 | Kritzer . | |
| 4,062,358 | 12/1977 | Kritzer . | |
| 4,114,616 | 9/1978 | Brawn . | |
| 4,155,547 | 5/1979 | Savio et al. . | |
| 4,158,360 | 6/1979 | Adams . | |
| 4,221,381 | 9/1980 | Ericson . | |
| 4,275,722 | 6/1981 | Sorensen . | |
| 4,291,704 | 9/1981 | Petty et al. . | |
| 4,345,605 | 8/1982 | Gereg . | |
| 4,365,628 | 12/1982 | Hodel . | |
| 4,403,616 | 9/1983 | King . | |
| 4,444,202 | 4/1984 | Rubin et al. . | |
| 4,473,082 | 9/1984 | Gereg . | |
| 4,533,137 | 8/1985 | Sonne . | |
| 4,601,465 | 7/1986 | Roy . | |
| 4,635,647 | 1/1987 | Choksi . | |
| 4,739,987 | 4/1988 | Nicholson . | |
| 4,770,413 | 9/1988 | Green . | |
| 4,854,574 | 8/1989 | Larson et al. . | |
| 4,973,047 | 11/1990 | Norell . | |
| 4,981,295 | 1/1991 | Belman et al. . | |
| 5,018,517 | 5/1991 | Liardet . | |
| 5,154,167 | 10/1992 | Hepburn . | |
| 5,165,393 | 11/1992 | Kawaguchi . | |
| 5,193,529 | 3/1993 | Labaere . | |
| 5,263,908 | 11/1993 | Chen . | |
| 5,658,221 | 8/1997 | Hougen . | |

FOREIGN PATENT DOCUMENTS

| | | |
|---|---|---|
| 2379291 | 9/1978 | France . |

*Primary Examiner*—Richard J. Apley
*Assistant Examiner*—Victor K. Hwang
*Attorney, Agent, or Firm*—Howard & Howard

[57] ABSTRACT

A breathing apparatus having a main body with a generally cylindrical inner cavity. The main body has a main aperture for the user to breath into and at least two sets of outer openings. An inner cylinder is coaxially disposed within the inner cavity of the main body and is adapted to move relative to the main body. The inner cylinder has an open end adjacent the main aperture, and at least two sets of inner openings selectively matable with the openings in the main body upon movement of the inner cylinder with respect to the main body. By selecting the appropriate alignment of openings, varied amounts of resistance can be achieved.

8 Claims, 2 Drawing Sheets

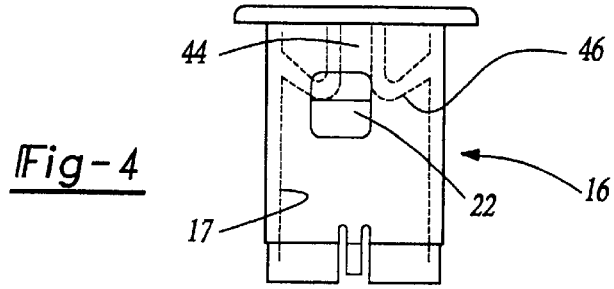
Fig-4
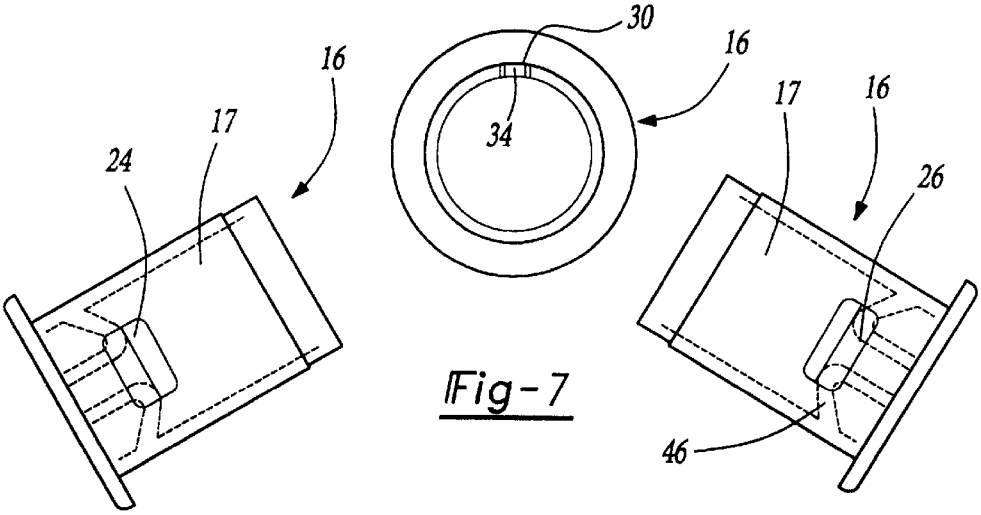
Fig-7
Fig-6
Fig-5
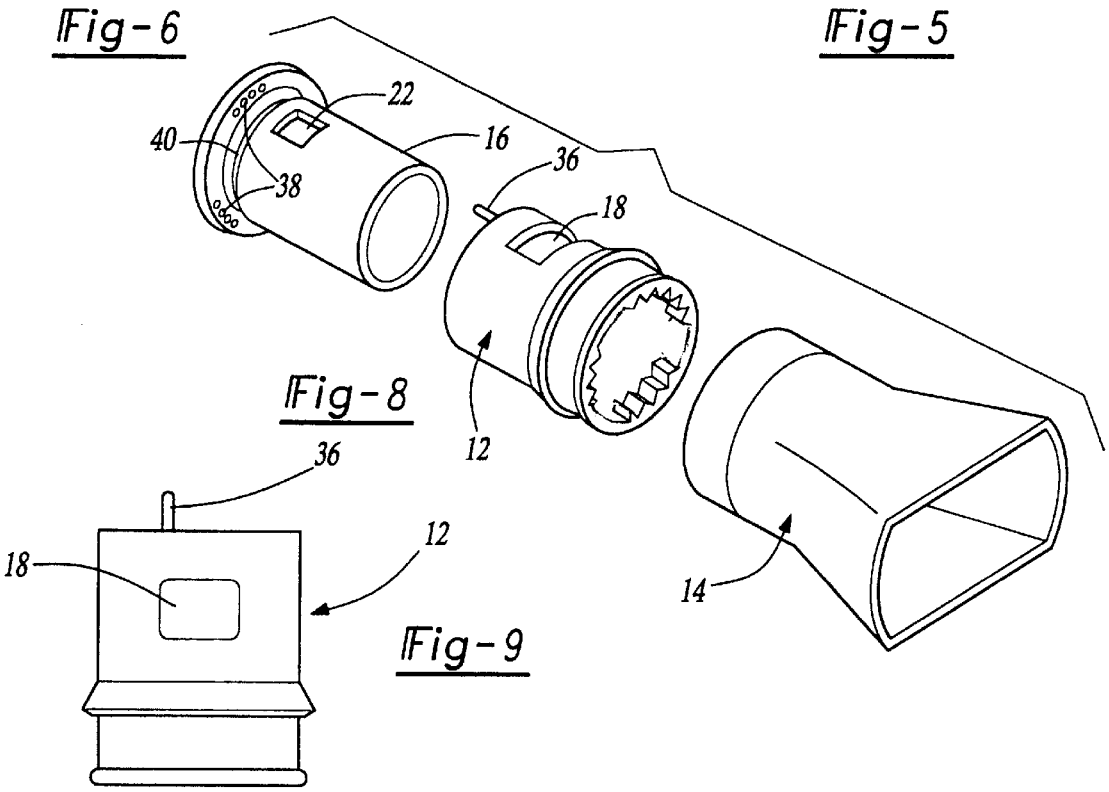
Fig-8
Fig-9

COMPACT LUNG EXERCISING DEVICE

This application claims the benefit of U.S. Provisional Application No. 60/019,796, filed Jun. 14, 1996.

BACKGROUND OF THE INVENTION

The present invention relates to a portable respiratory exercise apparatus providing resistance and intra-trachea bronchial percussion on inspiration and expiration to increase pulmonary efficiency, while improving cilial movement which assists mobilization of intrabronchial mucous or secretions within the lungs.

Research has shown that by practicing deep abdominal breathing, abdominal muscle pressure and temperature are raised, digestion and absorption of foods are improved and pulmonary efficiency is increased. In addition, taking deep breaths while performing little physical movement causes a superfluous amount of oxygen to be made available. Because the large muscular tissue is not consuming the oxygen an increased oxygen supply is made available for many other body systems, such as the brain and the heart.

Forcible and prolonged inspiration and expiration causes a greater expansion and collapse of the air vesicles (alveoli), especially those deep in the lung tissue. By providing resistance to inspiration and expiration, pulmonary muscles are strengthened and developed, thereby allowing a freer and greater exchange of oxygen and carbon dioxide. Persons suffering from lung ailments, healthy persons, and athletes can all improve their pulmonary efficiency through forcible and prolonged inspiration and expiration against resistance.

Some people are able to take only shallow breaths because they are suffering from lung ailments such as asthma, emphysema, chronic bronchitis, chronic obstructive pulmonary disease, or other ailments which reduce the oxygen/$CO_2$ exchange. Frequently, patients recovering from abdominal surgery experience pain during deep breathing and may therefore restrict their own breathing to shallow breaths. In both of the above situations, recovery is slowed because the patients suffer from reduced exchange of oxygen and carbon dioxide in the tissue. Further, the patients are at risk of developing atelectasis because their lungs are not being fully expanded. Atelectasis is a partial collapse of the lungs, possibly leading to necrosis of the lung alveoli. This exacerbates any ailments from which the patient may be suffering by causing poor oxygen exchange in the lungs and possibly resulting in pneumonia.

Patients with emphysema further suffer from mucous blockages in the lungs. Cilia, tiny hairlike structures in the lungs, become flattened down and clogged by mucous. Vibration of the air during inspiration or expiration can cause vibration of the lungs, lung passages (bronchi), and cilia of the patient. This vibration sometimes provides relief to the patient by bringing the cilia to an upright position and mobilizing the mucous, facilitating the expectoration thereof.

Known respiratory exercisers utilize a ball inside a large tube. A user exhales or inhales through a smaller attached tube, causing the ball to rise proportionally to the rate of airflow. However, these known respiratory exercisers only provide resistance to inspiration or expiration, but not both. Further, the large tube must be maintained in a vertical position in order for the respiratory exerciser to operate correctly. This is inconvenient for persons suffering from lung ailments who may be confined to bed and for athletes who wish to restrict respiratory volume flow during exercise. Still further, this respiratory exerciser does not provide a percussive effect on the user.

Another known respiratory exerciser provides a mask which allows air to be inhaled freely and provides resistance against the expiration of air. The masks do not provide resistance to inspiration and do not provide vibration. Further, the masks are too large to be conveniently portable.

Another respiratory exerciser provides a vibration effect upon expiration. A patient exhales into a tube connected to a conical element loosely supporting a ball. When a patient exhales through the tube, the ball is displaced from the conical element causing an oscillatory movement of the ball, thereby generating a variable pressure opposing the expiration. There are several disadvantages to this device. It is inconvenient for some patients because it must be maintained at a horizontal position during use. Further, the device provides only varying oscillations in air pressure, rather than a sharp percussion of the air by rapid bursts of air pressure from complete opening and closure of the air passages.

Another respiratory exerciser provides a vibration effect upon either inspiration or expiration by using a pair of adjacent air passageways each containing a reed. Each passageway contains a valve utilizing a coil spring to allow either inspiration or expiration. The compression of each spring can be adjusted to vary the resistance to inspiration and expiration independently. As the patient inhales through one passageway and exhales through the other, air flowing past each reed causes each reed to rapidly vibrate, causing a vibration effect on the lungs of the patient. However, adjustment of the coil spring compression during inspiration and expiration is not convenient. Further, vibration of the air is not as effective as would be a sharp percussion of the air by rapid, complete opening and closure of the air passages.

SUMMARY OF THE INVENTION

The present invention provides a respiratory exercise apparatus which is portable, non-positional, and provides resistance during inspiration and expiration and percussion during expiration. The user can select whether to exercise through resistance or percussion. The breathing apparatus has a main body and a movable inner member, which in the preferred embodiment is an inner cylinder. Preferably, both the main body and the inner cylinder have holes for resistance and percussion exercises. By rotating the inner cylinder and locking it in place, the desired resistance can be selected.

The compact breathing device of the present invention has an outer and inner body. The outer body has first and second open ends with at least one first aperture positioned between the first and second open ends. The inner body has a third open end and a closed end and at least one second aperture positioned between the third open end and the closed end. The inner body is positioned within the outer body with the third opening being generally adjacent to the first opening and with the first and second apertures being in communication to define an air passage. The inner body is adapted to reciprocate with respect to the outer body to vary the size of the air passage by moving the first and second apertures with respect to one another and thereby vary the resistance to air passing through the air passage.

In the preferred embodiment, there are a plurality of first or second apertures having different sizes on either the inner member or the outer member to provide varied resistance through the air passage which is created by aligning the various first and second apertures. The inner member and outer member are adapted to be realigned with one another to position the plurality of apertures with respect to one another.

The breathing device includes a locking means to lock the outer member with respect to the inner member. In the preferred embodiment, the locking means includes a plurality of notches on either the inner member or the outer member and a tab on the other of the inner member or the outer member which is adapted to mate with the notches to lock the inner and outer member with respect to one another. The notches are grouped into sets corresponding to the plurality of apertures to provide additional adjustment and corresponding varied restriction of air through the defined air passage.

The lung exercising device also includes a connector for interconnecting oxygen. The connector extends internally into the device to maintain the compactness of the device.

It will be apparent to one of ordinary skill that other embodiments could be used to obtain similar results and objectives and still be within the scope of the invention. With reference to the following description of the drawings and disclosure, the invention will be described.

DESCRIPTION OF THE DRAWINGS

The above, as well as other advantages of the present invention, will become readily apparent to those skilled in the art from the following description of a preferred embodiment when considered in the light of the accompanying drawings in which:

FIGS. 4, 5, and 6 are side views of the inner member of the breathing device of the present invention.

FIG. 7 is an end view of the inner member.

FIG. 8 is a further embodiment of the present invention.

FIG. 9 is a side view of the outer member.

DETAILED DESCRIPTION

Figure 1:
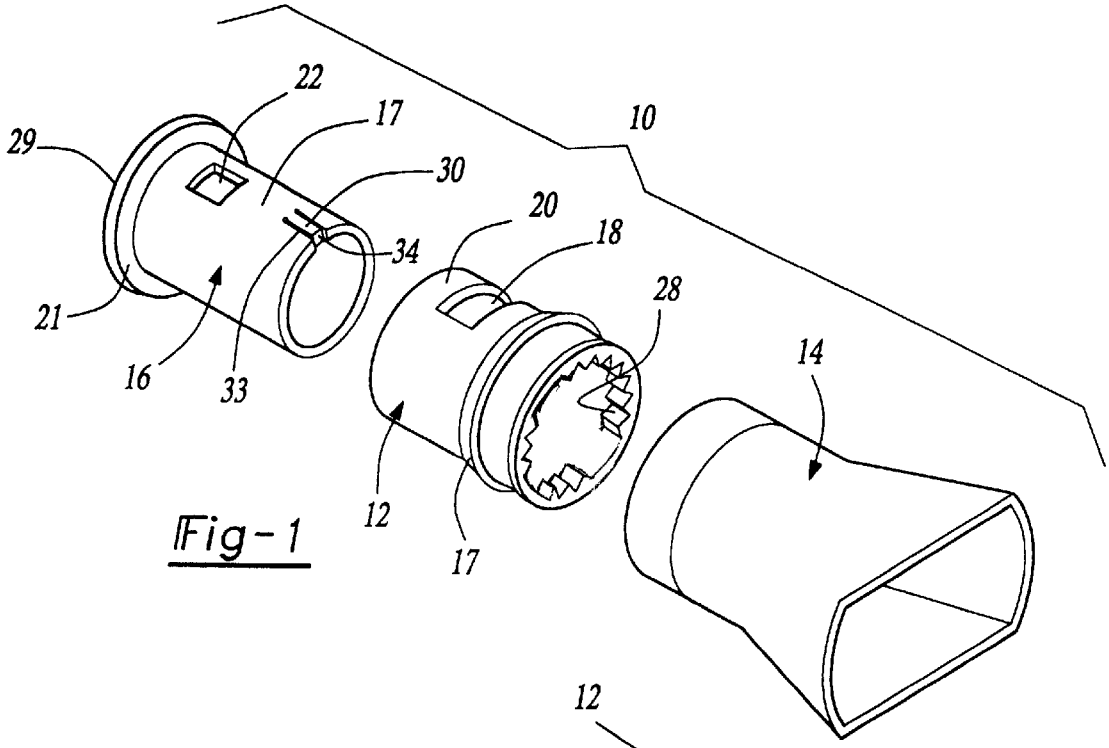
FIG. 1 is a perspective view of the compact breathing device of the present invention.
Figure 2:
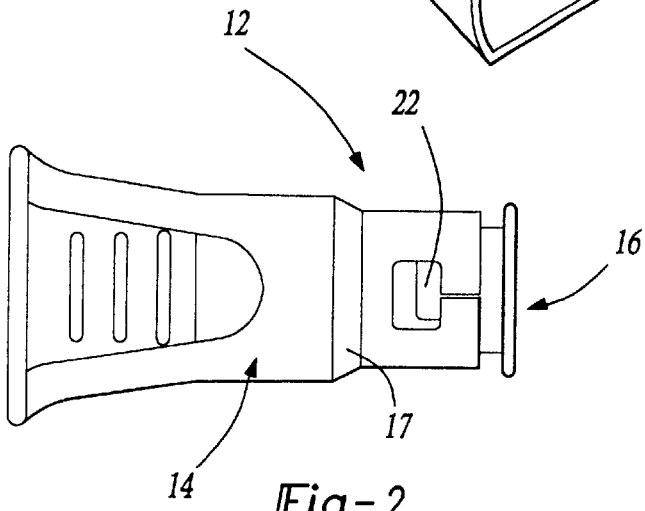
FIG. 2 is a side view of the body member of the breathing device of the present invention.
Figure 3:
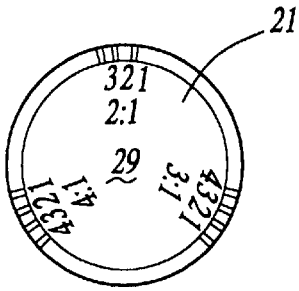
FIG. 3 is an end of the body member.

With reference to FIG. 1, the lung exercising device of the present invention is illustrated generally at 10. The lung exercising device 10 includes a body member 12, a mouthpiece 14 and an inner control member 16. In the disclosed embodiment, the body 12 and inner control member 16 are cylindrical; however, it should be understood that other shapes would be acceptable, such as oval, square, triangular, hexagonal, etc. A flange 17 is provided on the body member 12 to position the mouthpiece 14 on the body member 12.

In the disclosed embodiment, the body member 12 is open at both ends and has an opening 18 in the side 20. The inner control member 16 is open at one end and closed at the other end. Openings 22, 24, and 26 are formed in the sidewall 17 of the inner control member 16, see FIGS. 4,5 and 6. In the disclosed embodiment, the closed end 29 of the inner control member 16 has a flange 21 that facilitates rotation of the control member 16 for adjustment. Each of the openings 22, 24 and 26 have a different size to provide varied resistance to the users inhaling and exhaling. By rotating the inner control member 16 with respect to the body member 12, opening 18 is aligned with one of the openings 22, 24, or 26. Since the openings 22, 24 and 26 have different sizes, the air passage created through the sidewall of the inner member 16 and body member 12 has a different size.

To hold the body and inner control member in place, the preferred embodiment includes notches 28 which extend longitudinally into the body member 12 to receive a pawl 30 that is mounted on the control member 16. The illustrated pawl 30 is a small lever 33 formed by cutting into the end of the control member. A tab 34 is formed on the end of the lever 33 which mates with the notches 28. In the disclosed embodiment, there are three sets of notches 28 which provide varied resistance with respect to one another and varied resistance between inhaling and exhaling. In the disclosed embodiment, the resistance between inhaling and exhaling is 2:1, 3:1 and 4:1, with the size of the opening being larger on inhaling and smaller on exhaling. The resistance provided within each of the ratios is further varied by stepping the inner member 16 with respect to the body member 12. In the disclosed embodiment, there are three groups of notches 28 with each group having four notches. By rotating the inner and body member within a specific group of notches 28, the air passage created between openings 18 and one of openings 22, 24 and 26 is made smaller to further restrict inhaling and exhaling.

As should be appreciated, other methods could be used to hold the inner control member 16 with respect to the body member 12. For example, instead of single pawl 30, a plurality of pawls 30 could be used. With reference to FIG. 8, a further example is illustrated. In this example, instead of a pawl 30, a pin 36 and plurality of apertures 38 are used. As disclosed, the inner control member 16 has the apertures and a groove 40 spaced from the end of member 16. A key positioned internally in the outer member 12 rides in the groove 40 to restrict the inner member 16 so that it isn't pulled partially out of the body member 12. To adjust the resistance, the inner member is pulled out of the body member 12 to release the pin 36 from one of the apertures 38 so that the inner member 16 can be rotated. Once the inner member 16 and body member 12 are rotated to the desired resistance by aligning the pin 36 with an appropriate aperture 38, the pin 36 can be inserted into the aperture to hold the relative position. It should be understood that the pin could be positioned on inner member 16 and the apertures 38 in the end of outer member 12.

The lung exercising device of the this embodiment can also have an oxygen connector 44. See FIGS. 4 through 6 which show connector 44 in phantom. In the preferred embodiment, the oxygen connector 44 is positioned internally to maintain the compactness of the breathing device 10. The connector 44 extends outwardly from an internally extending cone 46. The oxygen connector 44 allows oxygen to be introduced to the user as the exercising device 10 is being used.

In the preferred embodiment, the outer and inner members 12 and 16 are made of plastic. The outer member 12 is approximately 1.07 inches in length and about 0.88 inches in diameter. The opening 18 is approximately 0.250 inches long and 0.360 inches wide. The notches 28 are equally spaced over 30° and about 120° apart. The inner member 16 is about 1.11 inches in length and about 0.729 inches in diameter. The flange 21 has a diameter of 0.98 inches. The openings 22, 24, and 26 are about 120° apart. The opening 22 is about 0.187 inches long by 0.323 inches wide. The opening 24 is about 0.169 inches wide by 0.360 inches wide. The opening 26 is about 0.250 inches long by 0.244 inches wide.

In use, the user rotates the inner member or control member 16 with respect to the outer member or body member 12 to adjust the resistance. As disclosed above, there are three sets of notches 28 into which the tab 34 can engage one of four notches 28. The user then inserts the mouthpiece 14 into his or her mouth and inhales and exhales. On inhaling, the control member 16 is pulled into the body member 12 to open the air passage to its widest extent at the particular setting, ie. 2:1; 3:1; or 4:1. The user then exhales which forces the control member 16 out of the body member 12 to partially close the air passage and restrict the egress of air from the breathing device 10. By rotating the control member 16 within one of the four notches of each notch group 28, the resistance can be further adjusted within that grouping, but the ratio of inhaling to exhaling remains the same, ie. 2:1; 3:1 or 4:1. To get percussion when exhaling, the inner member 16 can be tapped by the user while exhaling. The rapid tapping of the inner member opens and closes the air passage to thereby percuss the user's lungs.

In accordance with the provisions of the patent statutes, the present invention has been described in what is considered to represent its preferred embodiment. However, it should be noted that the invention can be practiced otherwise than as specifically illustrated and described without departing from its spirit or scope.

what is claimed is:

1. A lung exercising device comprising:

an outer body having first and second open ends with at least one first aperture positioned between the first and second open ends;

an inner body having a third open end and a closed end and at least one second aperture positioned between said third open end and the closed end;

the inner body is positionable within the outer body with the third open end being generally adjacent to the first open end and with the first and second apertures being in selective communication to define an air passage;

the first or second apertures having different sizes on either the inner body or the outer body to provide varied resistance through the air passage defined by alignment of the first and second apertures;

a locking member having a plurality of notches on either the inner body or the outer body and a tab on the other of the inner body or the outer body which mate with the notches to selectively align the inner and outer body with respect to one another;

the notches are grouped to provide additional adjustment and corresponding varied restriction of air through the defined air passage; and the inner body slidably reciprocates with respect to the outer body to vary the size of the air passage by moving the first and second apertures with respect to one another for air inhaled from or exhaled into the first open end by a user;

whereby breathing exercises can be selectively performed.

2. The lung exercising device of claim 1, wherein the inner and outer bodies are cylindrical tubes which are rotatable with respect to one another to align the various first and second apertures which selectively define the air passage.

3. The lung exercising device of claim 1, wherein the inner body has at least two spaced second apertures and at least two notches corresponding to each second aperture to define at least four different air flow restrictions through the air passage.

4. The lung exercising device of claim 1, further including a connector for interconnecting oxygen which extends internally into said device to maintain the compactness of the device.

5. The lung exercising device of claim 4, wherein the device includes an inwardly extending cone and the connector protrudes from the cone.

6. A method for exercising the lungs, including the steps of:

providing a lung exercising device having an inner body slidably mounted in an outer body;

positioning the inner body with respect to the outer body to adjust the resistance to inhaling and exhaling;

inhaling into the device to slide the inner body into the outer body to provide a first resistance; and exhaling into the device to slide the inner body partially out of the outer body to provide a second resistance.

7. The method of claim 6, wherein the inner body and the outer body create an air passage in the lung exercising device and the inner body is rapidly tapped to open and close the air passage to percuss the user's lungs during exhalation.

8. The method of claim 6, wherein the lung exercising device includes an oxygen connector and oxygen is connected to provide oxygen to the user.

* * * * *